US005868319A

United States Patent [19]

Gilmore

[11] Patent Number: 5,868,319

[45] Date of Patent: Feb. 9, 1999

[54] ADHESIVE DISPENSING SYSTEM

[76] Inventor: Darren Mark Gilmore, 2 Oakwood Ave., North Haledon, N.J. 07508

[21] Appl. No.: 852,760

[22] Filed: May 7, 1997

[51] Int. Cl.[6] ..... B05B 1/28; B05B 15/06

[52] U.S. Cl. ..... 239/290; 239/273; 239/323; 239/379; 239/8; 222/105

[58] Field of Search ..... 222/105, 185.1, 222/330, 183; 239/8, 74, 273, 290, 300, 302, 320, 323, 328, 379

[56] References Cited

U.S. PATENT DOCUMENTS

| | | | |
|---|---|---|---|
| 2,154,363 | 4/1939 | Seybold | 101/416 |
| 2,831,610 | 4/1958 | Dennie . | |
| 3,052,417 | 9/1962 | Daniel . | |
| 3,081,911 | 3/1963 | Scholle . | |
| 3,096,225 | 7/1963 | Carr et al. | 239/290 X |
| 3,243,084 | 3/1966 | Stegner | 222/105 X |
| 3,554,256 | 1/1971 | Anderson . | |
| 3,895,742 | 7/1975 | Wulbern . | |
| 3,945,534 | 3/1976 | Ady . | |
| 4,020,975 | 5/1977 | Stauffer . | |
| 4,090,514 | 5/1978 | Hinck et al. . | |
| 4,375,864 | 3/1983 | Savage | 222/105 X |
| 4,527,716 | 7/1985 | Haas et al. | 222/105 X |
| 4,551,139 | 11/1985 | Plaas et al. . | |
| 4,603,793 | 8/1986 | Stern . | |
| 5,265,766 | 11/1993 | Kurtzahn et al. | 222/105 |
| 5,316,215 | 5/1994 | Mitchell | 239/323 |
| 5,318,198 | 6/1994 | Micek et al. | 222/105 |
| 5,535,779 | 7/1996 | Huang | 239/74 |

*Primary Examiner*—Andres Kashnikow
*Assistant Examiner*—Robin O. Evans
*Attorney, Agent, or Firm*—Weingram & Associates, P.C.

[57] ABSTRACT

A system for applying an adhesive is provided which includes a flexible tote elevated above an underlying surface to provide a gravity head for feeding the adhesive to a spray gun for admixture with compressed air so that the adhesive can be applied in a predetermined pattern.

15 Claims, 2 Drawing Sheets

ADHESIVE DISPENSING SYSTEM

BACKGROUND OF THE INVENTION

1. Field of the Invention

The present invention relates to apparatus and systems for dispensing adhesives by gravity feed and in particular, to those apparatus and systems which reduce the pressure of the adhesive prior to being dispensed.

2. Description of the Related Art

Devices and systems are known to employ gravity feed to dispense liquid products. For example:

| U.S. Pat. No. | Inventor(s) |
|---|---|
| 2,831,610 | Dennie |
| 3,052,417 | Daniel |
| 3,081,911 | Scholle |
| 3,554,256 | Anderson |
| 3,895,742 | Wulbern |
| 3,945,534 | Ady |
| 4,020.975 | Stauffer |
| 4,090,514 | Hinck et al. |
| 4,551,139 | Plaas et al. |
| 4,603,793 | Stern |

U.S. Pat. No. 2,831,610 to Dennie discloses a liquid dispensing container consisting of a carton in which a flexible bag is disposed and secured to a nozzle from which the contents of the flexible bag can be dispensed.

U.S. Pat. No. 3,052,417 to Daniel discloses a dispensing apparatus consisting of an elongated body into which detergent is gravity fed, and an inclined tubular arm connected to the body portion in communication therewith through which water is discharged from the body portion. The structure of the device is such that mixing of the concentrate (detergent) and water is accomplished subsequent to the discharge from the instant spray device.

U.S. Pat. No. 3,081,911 to Scholle discloses a drainage fitting for a collapsible container.

U.S. Pat. No. 3,554,256 to Anderson discloses a flexible intravenous container consisting of a sealed flexible bag in which intravenous fluid is contained for being gravity fed through an outlet connector.

U.S. Pat. No. 3,895,742 to Wulbern discloses a collapsible container consisting of a flexible membrane in which water may be carried. Straps extend along an exterior of the membrane to give it shape and support when the membrane is inflated with water. Water is dispensed through the hose substantially under gravity feed.

U.S. Pat. No. 3,945,534 to Ady discloses a food preparation and dispensing system consisting of an outer housing and an inner housing extending through an opening in the outer housing, and a food package arranged in the inner housing. A valve assembly is provided to control dispensing of the contents of the food package from the inner housing.

U.S. Pat. No. 4,020,975 to Stauffer discloses a wall-mountable dispensing device for bulk and encapsulated materials consisting of a cylindrical housing adapted to telescopically receive a cup in which a capsule is disposed. Threading of the housing along the cup expels contents in the cup or contents in the capsule through a spout at a base of the cup.

U.S. Pat. No. 4,090,514 to Hinck et al. discloses a pressure infusion device consisting of a pair of inflatable sheets which are foldable over a liquid-filled plastic bag, the sheets being inflated to exert pressure on the bag and expel the contents therefrom through an outlet of the bag.

U.S. Pat. No. 4,551,139 to Plaas et al. discloses a method and apparatus for burned wound treatment consisting of a container for the treating agent, a spray nozzle, a roller to urge the contents of the container to an outlet therefrom, and a pump unit to convey a pressurized flow of the agent from the container outlet to the spray nozzle. The treating agent is isolated from ambient air.

U.S. Pat. No. 4,603,791 to Stern discloses a coupling device for connecting a material outlet to a packing.

OBJECTS AND SUMMARY OF THE INVENTION

It is an object of the present invention to provide a system for delivering fluids, such as a water based adhesive, under the effect of gravity to a work surface.

It is another object of the present invention to provide a system which delivers water based adhesive under low pressure to a work surface to be bonded.

It is another object of the present invention to provide a system for delivery of the water borne adhesive such that a visual inspection can be made to determine the amount of adhesive remaining in the system.

It is another object of the present invention to provide a system to deliver a water borne adhesive to a plurality of spray stations without using pumps, regulators or pressure tanks to deploy the adhesive.

It is another object of the present invention to provide a system to administer a water borne adhesive, wherein a container for the adhesive is elevated off a shop or factory floor thereby providing additional space on the shop and/or factory floor.

It is another object of the present invention to provide a system for dispensing a water borne adhesive, wherein the system is easily retrofitted to existing manufacturing facilities.

It is another object of the present invention to provide a system for dispensing water borne adhesives wherein the adhesive is segregated and hermetically sealed from contaminants throughout the system until dispensed from a spray gun of the system.

It is another object of the present invention to provide an adhesive dispensing system which dispenses a water based adhesive, thereby reducing hazardous conditions in a manufacturing environment.

The present invention includes an apparatus for dispensing adhesive having a dispensing means for dispensing the adhesive, high pressure air supply means and adhesive supply means connected to the dispensing means, hermetically sealed container for the adhesive, an elevation means to support the hermetically sealed container above the dispensing means, an adhesive delivery means for conveying the adhesive from the hermetically sealed container to the dispensing means, and a control means operatively associated with the dispensing means to simultaneously control the high pressure air and the adhesive to enable dispensing of the adhesive in a predetermined pattern.

BRIEF DESCRIPTION OF THE DRAWINGS

For a more complete understanding of the present invention, reference may be had to the detailed description of the preferred embodiments taken in connection with the accompanying drawings, in which.

DETAILED DESCRIPTION OF THE PREFERRED EMBODIMENTS

Figure 1:
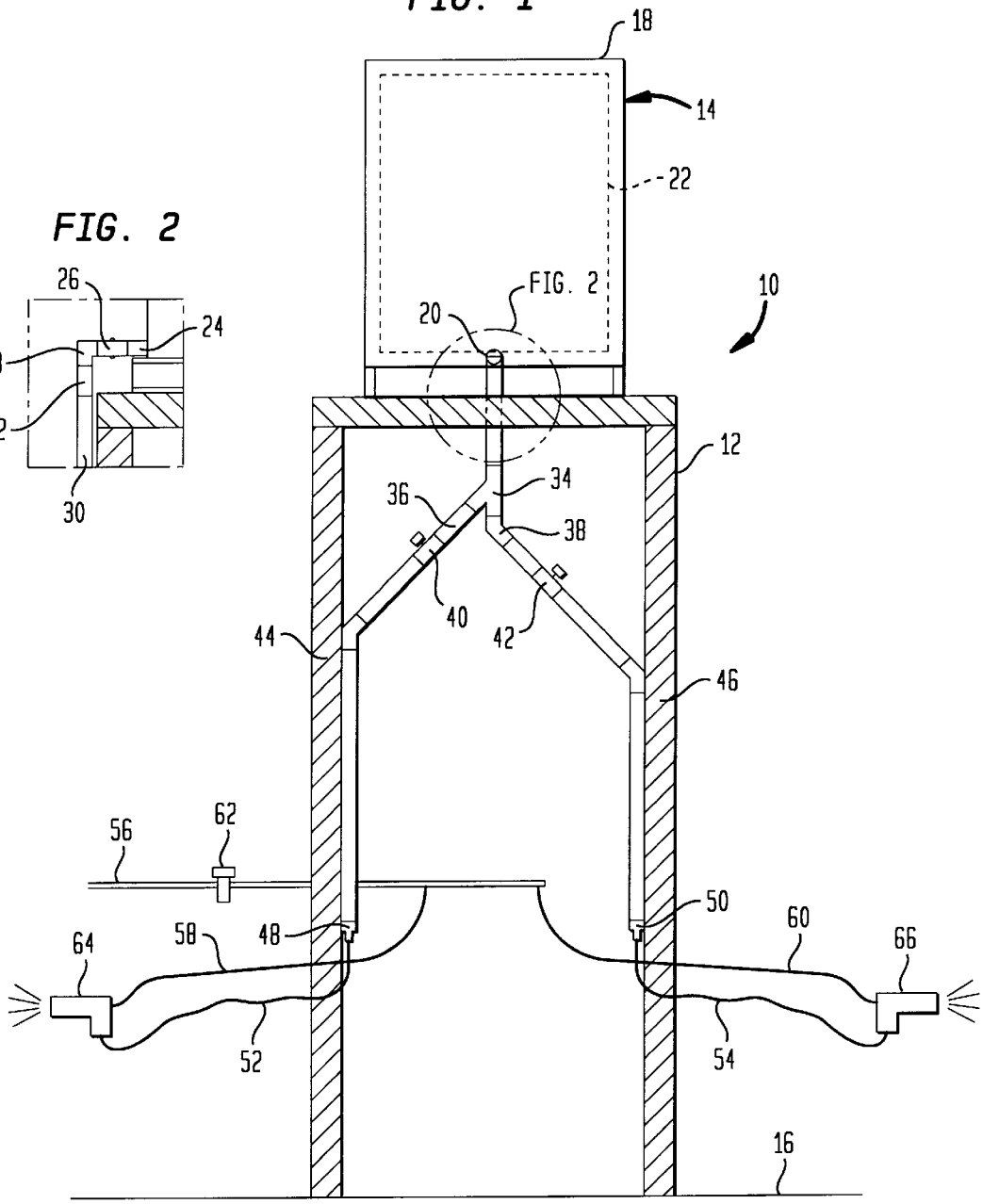
FIG. 1 is a partial cross-sectional view of an adhesive dispensing system according to the present invention.
Figure 2:
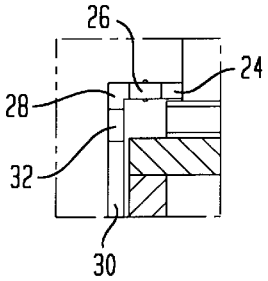
FIG. 2 is a view of a portion of the system shown in FIG. 1.

Referring to FIGS. 1 and 2, a dispensing system according to the present invention is indicated generally at 10 and includes a support means such as a platform 12 for supporting a container 14 off an underlying surface 16, such as a factory floor. The dispensing system 10 can be used with many different liquids, or liquid compositions, such as paints. It is well suited for dispensing liquid adhesive and particularly, water borne adhesive.

The container 14 consists of a cardboard shell 18 having a port 20 formed therein. A flexible hermetically sealed tote 22 or bladder is disposed in the container and is capable of storing from five (5) gallons to three hundred and thirty (330) gallons of a water based adhesive. The tote 22 is provided with a hermetically sealed valve 24 disposed near a bottom of the tote 22 to be in registration with the port 20 of the cardboard shell 18.

The valve 24 of the tote has a reciprocating valve stem which when depressed inward of the tote 22 provides a passageway for the adhesive to flow from inside the tote 22 out through the valve 24. When the valve stem 24 is pulled outward away from the tote 22, the passageway for the adhesive is secured and the adhesive is retained in the tote 22.

The valve 24 is connected to a quick disconnect coupling 26, which in turn is connected to an elbow joint 28, so that piping 30 or a riser for the adhesive now extends downward toward the factory floor 16.

The piping 30 is part of the dispensing means, preferably fixed and rigid, and is formed with a substantially transparent hose portion 32 as an indicator means so that the amount and flow of the adhesive can be viewed from the exterior of the system 10. The piping 30 is hermetically sealed. The transparent portion can consist of a separate piece interposed along the piping 30 beneath the elbow joint 28. The piping 30 below the transparent portion 32, is then bifurcated at 34 into a first branch 36 and a second branch 38 for the flow of the adhesive. Each one of the corresponding branches 36,38 is also provided with a corresponding ball valve 40, 42.

As shown in FIG. 1, the branches 36,38 are led down legs 44,46 of the support platform 12 and can, if desired, be strapped to a corresponding one of the legs for additional support. The lower end of each one of the branches 36,38 is provided with a corresponding ball valve 48,50. Hoses 52,54 are connected to a corresponding one of the ball valves 48,50 and are each directed to a respective dispensing means, such as spray guns 64,66. The spray guns 64,66 simultaneously actuate the dispensing of adhesive and high pressure air to form a predetermined spray pattern of the adhesive.

Compressed air for the system is provided through a compressed air line 56. A control means (not shown) controls the flow of air through the line 56. The compressed air line 56 functions as a manifold to which a pair of air hoses 58,60 are connected to deliver the compressed air to a respective one of the spray guns 64,66. Each one of the spray guns 64,66 also functions as a control means to control the simultaneous discharge of compressed air admixed with the adhesive.

An oil and water extractor 62 is interposed along the compressed air line 56. Regulators are used for atomizing air for the system.

A preferred construction of the system calls for the support platform 12 to be approximately 10' to 16' off the underlying surface 16.

The provision of the transparent hose 32 is to permit a view of the level of the adhesive remaining in the pressure "head" of the system to provide the gravity feed force necessary for the invention.

The ball valves 40,42 operate as safety valves to restrict the flow of the adhesive if only one of the first branch 36 and second branch 38 is to be employed during an adhesive spraying operation.

The use of the oil and water extractor 62 prevents the interjection of contaminants into the system which would be detrimental to and most likely dilute the adhesive composition which is contained premixed in the tote 22. Contaminants such as oil and water in the compressed air detrimentally impact on the atomization of the adhesive when it is mixed with the compressed air for application to a surface to be bonded.

The tote 22 is disposable or can be reused after it has gone through the proper recycling procedures.

Preferable dimensions for each of the elements of the system are as follows: the quick disconnect coupling 26 preferably 2" PVC, and the transparent flexible hose is preferably a 2" nylon. The support platform 12 is preferably no less than 10' above the surface 16 and should be able to support as much 2,500 lbs., if the 250 lb. tote 22 is being used. Steel or other similar alloys are preferred to construct the support platform 12. The piping 30 is preferably 2" PVC piping, Schedule 40 or 80. The ball (40 or 80) valves 48,50 are preferably stainless steel ball valves with a ½" hose barb. The air hoses 58,60 are conventional air hoses, as are the spray guns 64,66. The air pressure is approximately 25–35 psi coming into the spray guns and is reduced to preferably 6–8 psi for the atomizing air; to deploy the adhesive to a work piece. The adhesive hoses 52,54 are preferably ½" 1D nylon fluid hoses.

Figure 3:
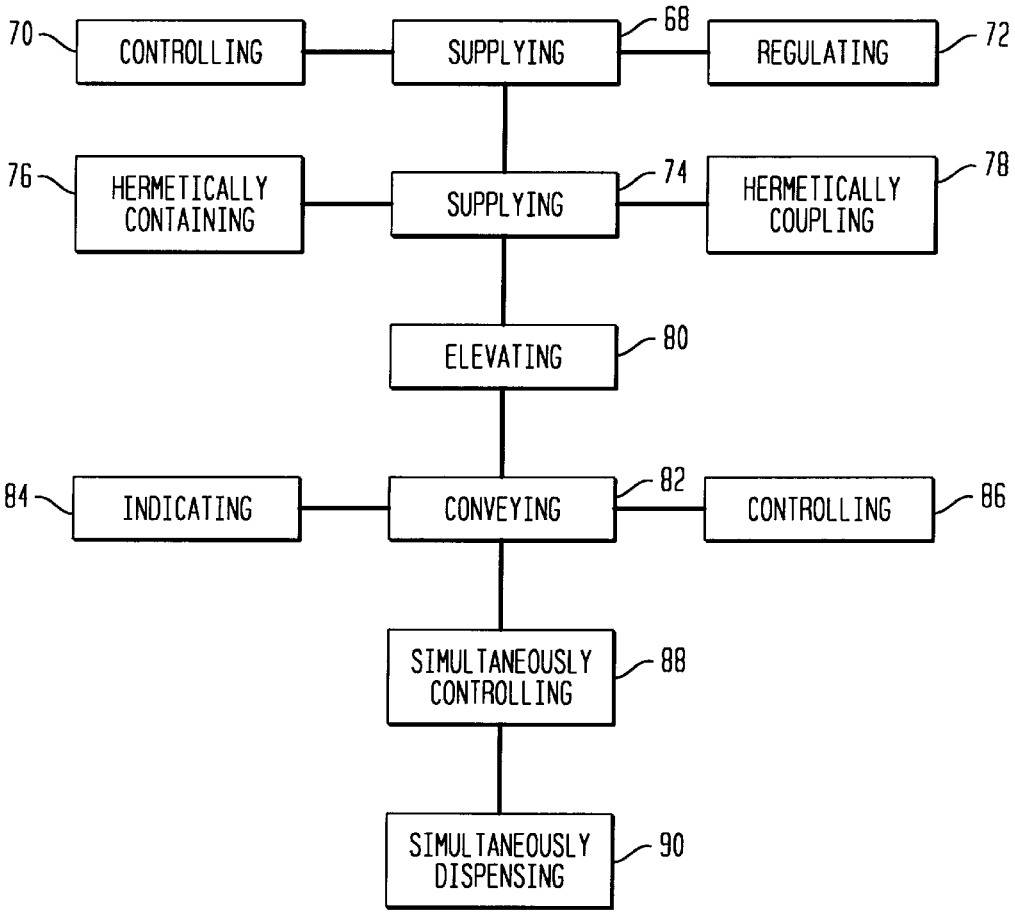
FIG. 3 is a flow chart of steps employed to carry out the method according to the present invention.

A flow chart for a method of steps to dispense a liquid or an adhesive according to the present invention is shown in FIG. 3. The method according to the present invention includes the steps of supplying 68 the high pressure air to the dispensing means and in doing so, controlling 70 and regulating 72 the supply of the high pressure air. The adhesive is then supplied 74, including the steps of hermetically containing 76 and hermetically coupling 78 the supply of the adhesive to the dispensing means. The supply of adhesive is elevated 80 so that during conveyance 82 of the adhesive under the effect of gravity to the dispensing means, the flow of the adhesive is indicated 84 and accordingly controlled 86 as it travels through the piping system to the dispensing apparatus. The next step is to simultaneously control 88 the contact of the high pressure air with the adhesive so that the adhesive and high pressure air can be simultaneously dispensed 90 in a predetermined spray pattern.

It will be understood that the embodiments described herein are merely exemplary and that a person skilled in the art may make many variations and modifications without departing from the spirit and scope of the invention. All such modification and variations are intended to be included within the scope of the invention as defined in the appended claims.

What is claimed is:

1. An apparatus for dispensing adhesive, comprising:

dispensing means for dispensing adhesive, the dispensing means having:

regulating means for regulating a high pressure air supply to the dispensing means, positioning means for positioning the high pressure air supply with respect to the adhesive, actuating means for simultaneously actuating the dispensing of adhesive and high pressure air to form a predetermined spray pattern of the adhesive;

high pressure air supply means connected to said dispensing means, the high pressure air supply means including:

control means for controlling the high pressure air supply;

adhesive supply means connected to said dispensing means, the adhesive supply means including:

a hermetically sealed flexible bladder in which the adhesive is disposed, a container for containing the flexible bladder, and a hermetically sealed coupling extending from the flexible bladder through the container and providing a hermetically sealed conduit through which the adhesive is removed from the bladder, elevational means for elevating the adhesive supply means;

adhesive delivery means for delivering the adhesive from the hermetically sealed coupling to the dispensing means, the adhesive delivery means having:

a hermetically sealed vertically disposed conduit constructed and arranged as a riser for delivery of the adhesive, the riser having:

fixed piping, indicator means in communication with the fixed piping to indicate the flow of adhesive, and first control means operatively associated with the fixed piping to control the flow of the adhesive, the control means including a ball valve;

a quick disconnect coupling disposed between and interconnecting the hermetically sealed coupling of the container and the fixed piping, and regulating means for regulating the flow of the adhesive;

flexible piping means extending from the fixed piping and operatively associated with said dispensing means; and second control means for controlling simultaneously the high pressure air and the adhesive to enable dispensing of the adhesive in a predetermined pattern.

2. An apparatus for dispensing a liquid, comprising:

dispensing means for dispensing liquid;

supply means for supplying the liquid to be dispensed;

air supply means connected to said dispensing means;

conveying means comprising:

a hermetically sealed vertically disposed conduit constructed and arranged as a riser for delivery of the liquid from the supply means to the dispensing means;

elevation means for elevating the supply means above the dispensing means; and first control means operatively associated with the dispensing means to simultaneously control the dispensing of the liquid and the air supply in a predetermined pattern.

3. The apparatus according to claim 2, wherein the dispensing means comprises:

regulating means for regulating air pressure to the dispensing means;

positioning means for positioning the air pressure with respect to the liquid; and actuating means for simultaneously actuating the dispensing of the liquid and the air pressure to form a predetermined spray pattern of the liquid.

4. The apparatus according to claim 3, wherein the air supply means is a high pressure air supply means having:

control means for controlling the high pressure air supply.

5. The apparatus according to claim 2, wherein the supply means comprises:

a hermetically sealed flexible bladder in which the liquid is disposed;

a container for containing the flexible bladder; and a hermetically sealed coupling extending from the flexible bladder through the container and providing hermetically sealed conduit through which the liquid flows from the bladder.

6. The apparatus according to claim 2, wherein the elevational means, comprises:

a platform having an upper surface at an elevation higher than the dispensing means.

7. The apparatus according to claim 2, wherein the riser comprises:

fixed piping;

indicator means in communication with the fixed piping to indicate the flow of liquid;

second control means operatively associated with the fixed piping to control the flow of the liquid, the second control means including a ball valve;

a quick disconnect coupling disposed between and interconnecting the riser and the supply means; and regulating means for regulating the flow of the liquid.

8. The apparatus according to claim 2, wherein the first control means comprises:

a spray gun.

9. The apparatus according to claim 2, wherein the liquid comprises an adhesive.

10. A method for dispensing an adhesive, the method comprising the steps of:

supplying high pressure air to a dispensing means, including the steps of:

controlling the supply of high pressure air, regulating the supply of the high pressure air;

supplying adhesive to the dispensing means, including the steps of:

hermetically containing a supply of the adhesive in a flexible bladder, hermetically coupling the flexible bladder to the dispensing means;

elevating the supply of adhesive above the dispensing means;

conveying the adhesive from the hermetically sealed container through a riser to the dispensing means, including the steps of:

indicating the flow of adhesive from the adhesive supply;

controlling the flow of adhesive from the adhesive supply;

regulating the amount of the adhesive to the dispensing means; and simultaneously dispensing adhesive and high pressure air to form a predetermined spray pattern of the adhesive.

11. A method for dispensing liquid, the method comprising the steps of:

supplying high pressure air to a dispensing means;

supplying liquid to the dispensing means, the step of supplying liquid including:

hermetically containing the supply of liquid, elevating the supply of liquid above the dispensing means, hermetically conveying the liquid from the hermetically sealed container through a riser to the dispensing means, and simultaneously dispensing the liquid and high pressure air to form a predetermined spray pattern of the liquid.

12. The method according to claim 11, wherein the step of supplying high pressure air includes the steps of:

controlling the supply of high pressure air, and regulating the supply of high pressure air.

13. The method according to claim 11, wherein the step of supplying liquid to the dispensing means further includes the steps of:

indicating a flow of liquid from the liquid supply, controlling the flow of liquid from the liquid supply, and regulating the amount of the liquid to the dispensing means.

14. The method according to claim 13, further comprising the step of:

hermetically coupling the hermetically contained supply of liquid with the dispensing means.

15. The method according to claim 11, wherein the liquid comprises an adhesive.

* * * * *